US006352494B2

(12) United States Patent
McAlonan

(10) Patent No.: US 6,352,494 B2
(45) Date of Patent: Mar. 5, 2002

(54) BUNGEE POLE

(76) Inventor: Mark McAlonan, 250 San Luis Way, Novato, CA (US) 94945

( * ) Notice: Subject to any disclaimer, the term of this patent is extended or adjusted under 35 U.S.C. 154(b) by 0 days.

(21) Appl. No.: 09/765,661

(22) Filed: Jan. 10, 2001

Related U.S. Application Data

(60) Provisional application No. 60/175,799, filed on Jan. 12, 2000.

(51) Int. Cl.[7] ..... A63B 26/00
(52) U.S. Cl. ..... 482/77; 472/135
(58) Field of Search ..... 482/51, 77, 148, 482/121, 123, 128, 133, 127, 26, 75, 76; 472/135

(56) References Cited

U.S. PATENT DOCUMENTS

,438,830 A * 10/1890 Yagn
2,783,997 A * 3/1957 Gaffney et al. ..... 272/57
4,243,218 A * 1/1981 DeSousa ..... 482/77

* cited by examiner

*Primary Examiner*—Stephen R. Crow
(74) *Attorney, Agent, or Firm*—Johnson & Stainbrook, LLP; Larry D. Johnson; Craig M. Stainbrook

(57) ABSTRACT

An adjustable jumping apparatus having a hollow housing with handlebars for a rider to hold and reinforced foot pegs for a rider to stand upon. A pole extends downwardly from the housing, has a ground-engaging base, and slides in and out of the housing through a sleeve integral with the lower end of the housing. The device is propelled by at least one bungee cord attached at its upper end to a disc integral with the upper end of the pole and at its lower end to the interior surface of the lower end of the housing. The device is adapted for easy installation and removal of bungee cords for adjusting the amount of rebound force available to the user.

11 Claims, 3 Drawing Sheets

BUNGEE POLE

CROSS-REFERENCE TO RELATED APPLICATIONS

The present invention claims the benefit of the filing date of U.S. Provisional patent application, Ser. No. 60/175799, filed Jan. 12, 2000.

BACKGROUND OF THE INVENTION

1. Field of the Invention

The present invention relates generally to a recreational exercise apparatus, and more particularly to an adjustable jumping apparatus that the user rides while bounding about in the fashion of a pogo stick.

2. Discussion of Related Art

The pogo stick is widely known and still in common use by children. There is something inherently but indescribably pleasurable in bouncing about while essentially standing on a stick. However, the pogo stick has never been well adapted for use by adults; the internally housed coil springs providing resiliency in the device tend to be stiff, slow to recoil, and ill-suited for heavier loads. Further, aside from the most ambitious child after a Guinness World Book of Records mark, even children tend to suffer a certain degree of boredom after using the pogo stick only a short time. This may be attributable to the effort required to produce a thrilling bounce, if any can be produced at all. Even so, the pogo stick remains an appealing toy.

Furthermore, the pogo stick is, at least potentially, a useful exercise device. Again, however, due to the mechanical and structural limitations of existing pogo-stick-type devices, they are not well-suited for exercise. They tend to impart a significant impact to joints and therefore expose the user to possible joint stress injury, and, as is well known, for long term health benefits and injury avoidance, low impact aerobic exercise is generally preferred by health experts. Moreover, conventional pogo sticks are not adjustable and are therefore useful to only a limited range of user sizes and weights. Finally, they are noisy.

While alternative designs have been proposed to overcome the foregoing disadvantages, such improvements generally entail the inclusion of expensive equipment or involve expensive manufacturing processes. What is needed, therefore, is a jumping device that is suitable for use by adults and children of all sizes and weights, that is adjustable, that provides the rider with a thrilling, bouncing ride, that minimizes the danger of joint stress and overuse injury, and that is inexpensive to manufacture.

SUMMARY OF THE INVENTION

The bungee pole of the present invention is an adjustable jumping apparatus suitable for use by riders of a wide range of sizes and weights. The inventive apparatus comprises an elongate, substantially hollow housing with reinforced foot pegs attached to its sides. The housing may be cylindrical in shape or any of a number of other polygonal shapes that define a hollow interior. A pole extends downwardly from the housing a and has a base for engagement with the ground during use. The pole slides into the housing through a sleeve integral with the lower end of the housing, which sleeve provides support to the pole and ensures that it moves in a generally straight line along the concentric longitudinal axes of the housing and the pole.

At the upper end of the pole is an integral disc having a plurality of loops fastened to its inferior surface. At least one bungee cord, and preferably a plurality, are connected at their upper ends to the loops and are interposed between the inferior surface of the disc and the interior surface of the lower end of the housing. The bungee cords are connected at their lower ends to a plurality of loops, which are, in turn, fastened to the interior surface of the lower end of the housing. The bungee cords have hooks at each end for removable connection to said loops. The bungee cords are easily removed or installed to tailor the device to the anticipated user. The loops may be removable or integral.

A set of handlebars having hand grips is connected to the upper end of the housing and preferably includes a shock absorber located at its neck. The upper end of housing is preferably removable so that the user can selectively remove or install bungee cords to suit his or her liking.

DETAILED DESCRIPTION OF A PREFERRED EMBODIMENT

Figure 1:
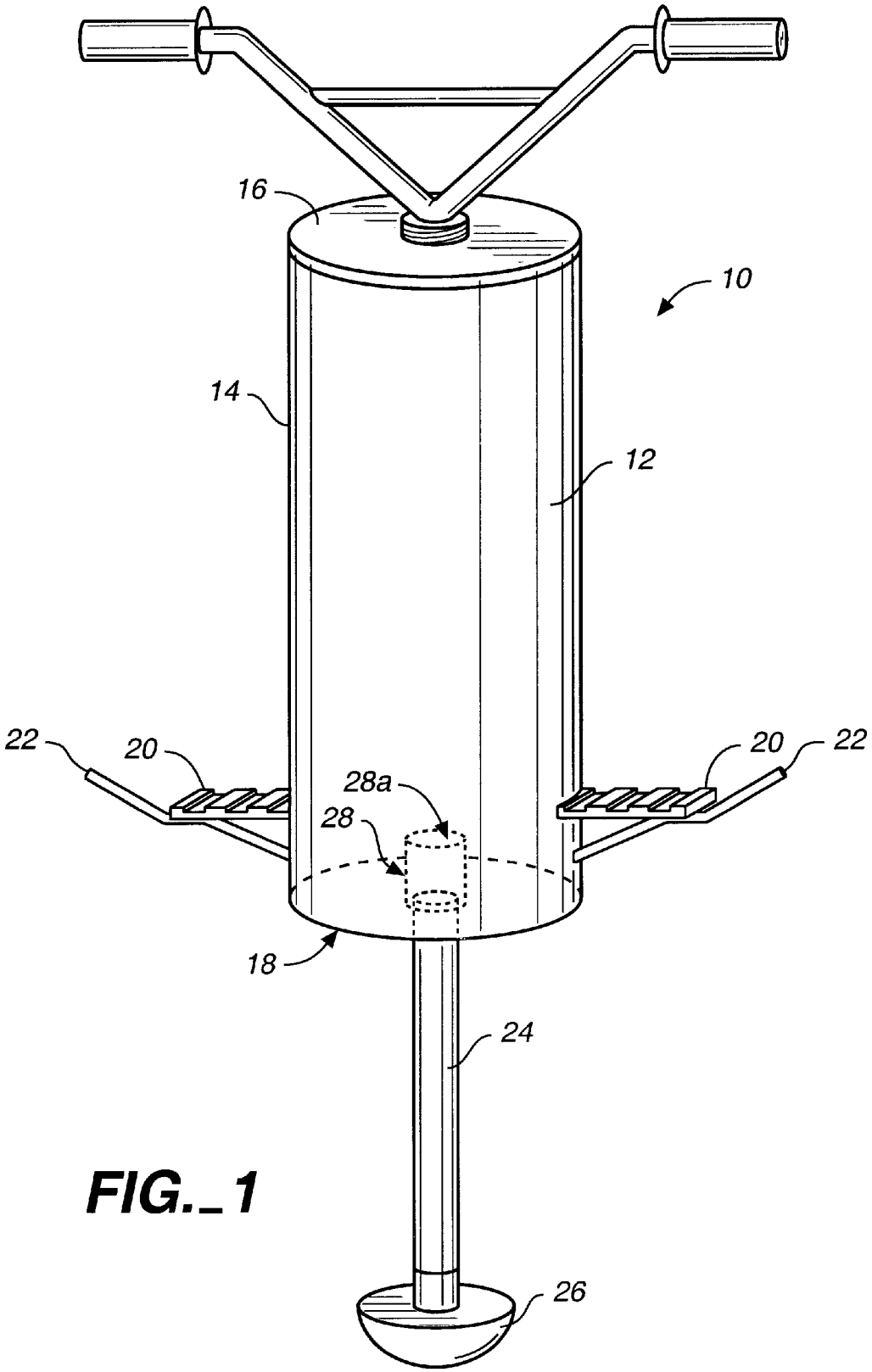
FIG. 1 As a side perspective view of the bungee pole jumping apparatus of the present invention.

FIG. 1 illustrates the bungee pole jumping apparatus 10 of the present invention, showing that the apparatus comprises an elongate, substantially hollow housing 12 having at least one vertical side surface 14 and an upper end 16, and a lower end 18. The housing 12 has reinforced foot pegs 14 attached to the at least one vertical side 14 on the lower portion of the housing 12. The foot pegs 20 are capable of supporting the weight of most reasonably anticipated users and preferably include side structure 22 to prevent the user's foot from slipping from the foot pegs when in use. The housing is preferably cylindrical in shape, but many polygonal shapes defining a hollow interior would be equally suitable as no functional limitations reside in the geometry of the housing other than its generally elongate shape.

Figure 2:
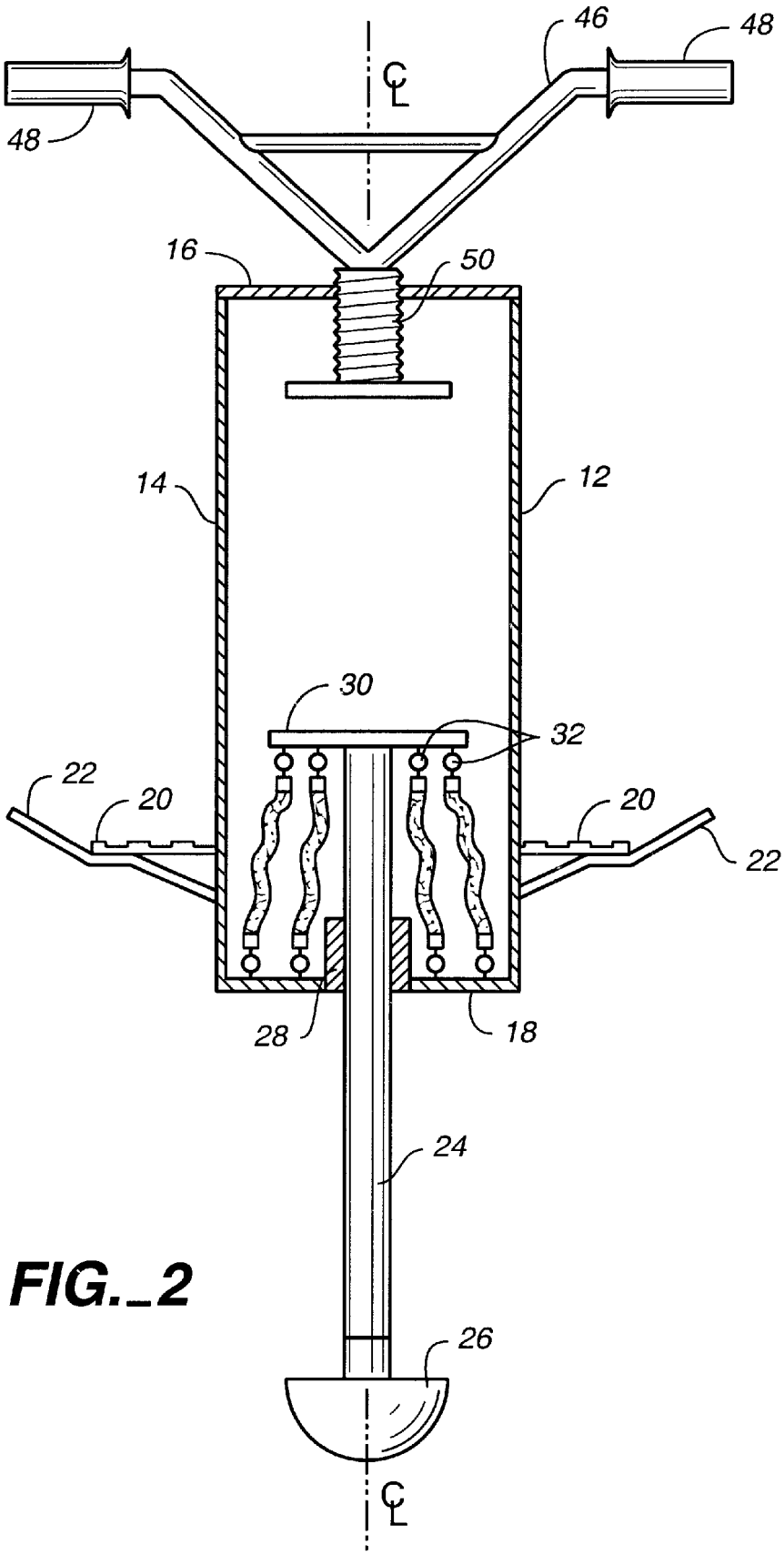
FIG. 2 is side elevation cross sectional view of the bungee pole showing the device in its fully extended configuration.
Figure 3:
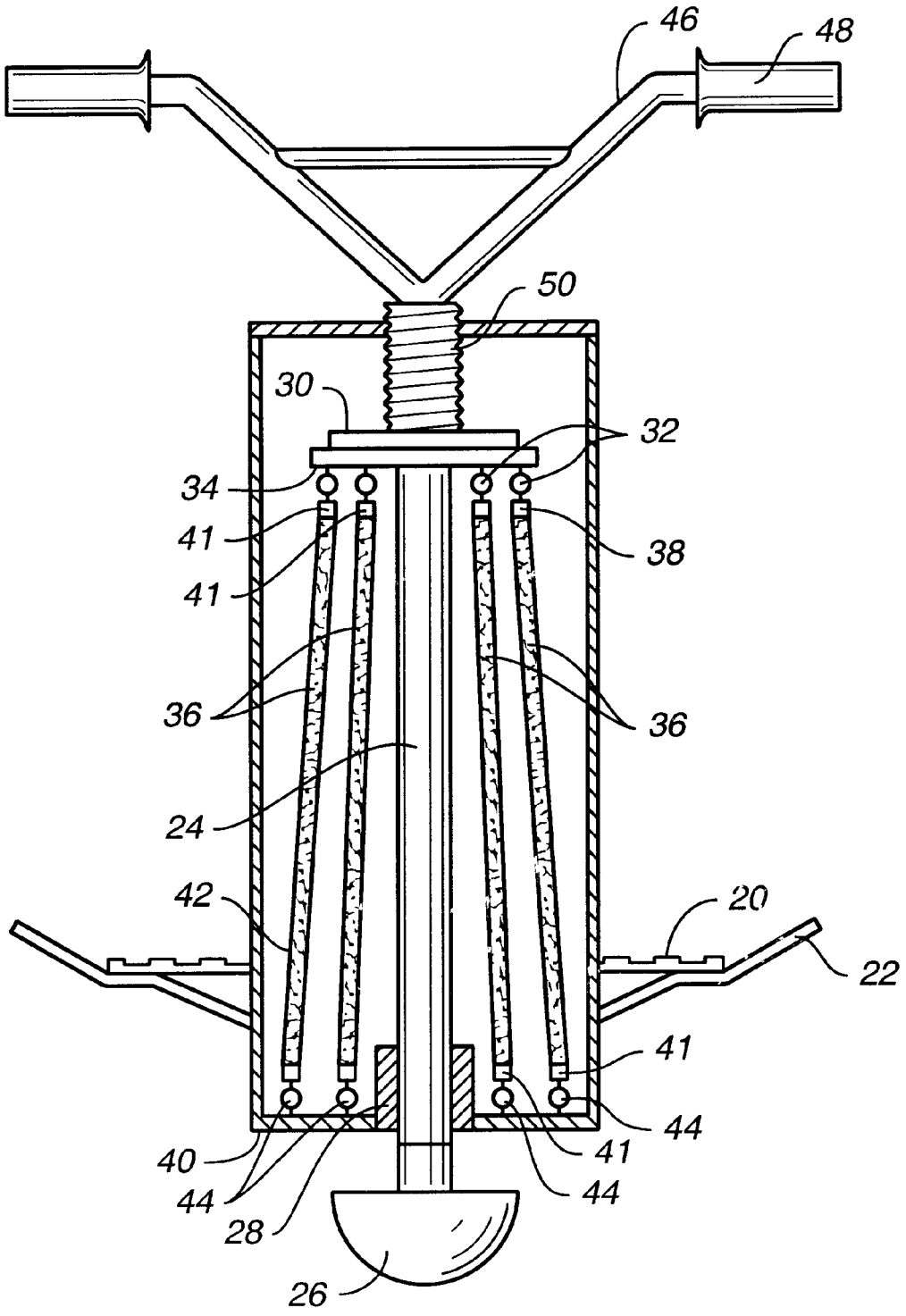
FIG. 3 is a side elevation cross sectional view showing the bungee pole in its compressed configuration.

FIGS. 1–3 show that the device further includes a pole 24 extending downwardly from the housing and having a base 26. The pole may be of any of a number of generally symmetrical shapes, but is preferably cylindrical. The pole 24 slidingly inserts into the housing through a sleeve 28 integral with the lower end 18 of said housing and defining an opening 28*a*, which may be of any shape to match the pole, but which is preferably cylindrical. Sleeve 28 provides structural support to the pole 24 and helps ensure that when used the pole moves smoothly up and down and in a substantially straight line along the longitudinal axis L of the housing 12. Longitudinal axis L of the housing 12 is concentric with the longitudinal axis of the pole 24. Sleeve 28 may be disposed upwardly into the interior of the housing or, alternatively, downwardly from the exterior surface of the lower end of the housing, or, again alternatively, it may be a combination of the two.

At the upper end 28 of the pole 24 is an integral disc 30 having a plurality of loops 32 fastened to its inferior surface 34. Disc 30 may be of any of a number of suitable shapes but is preferably generally planar. At least one bungee cord 36, and preferably a plurality, are connected at their upper ends 38 to the loops 32 and are interposed between the inferior surface of disc 30 and the interior surface 40 of the lower end 18 of housing 12. The bungee cords 36 are connected at their lower ends 42 to a plurality of loops 44, which are, in turn, fastened to the interior surface 40 of the lower end 18 of housing 12. The bungee cords have hooks 41 at each end for connection to said loops. The loops may be removable or integral.

A set of handlebars 46 having hand grips 48 is connected to the upper end 16 of housing 12 and preferably includes shock absorbing structure 50 located at the neck of the handlebars, for example, a coil spring, that allows for limited movement of the handlebars in every direction, thereby providing shock absorption and improving control of the device. The upper end 16 of housing 12 is preferably removable so that the user can selectively remove or install bungee cords to suit his or her liking. Additionally, bungee cords having varying degrees of elasticity and coefficients of restitution may be installed to adjust the liveliness of the device; that is, to increase or reduce the rebound action of the device. Bungee cords may also be double looped for even more added rebounding potential. As the user increases his or her skill and courage, bungee cords may be added to provide truly remarkable vertical rebound.

The bungee pole has an extended configuration, shown in FIG. 2, and a compressed configuration, shown in FIG. 3. Until weight is applied downwardly on the foot pegs 20, the device remains in the extended configuration. When a user stands on the device and initiates a bounding motion, the bungee pole extends and invests the bungee cords with the potential energy to propel the user high into the air upon rebound. At all times during use, however, the user is suspended by the elastic bungee cord; that is, he or she is quite literally hanging by the cords.

The present invention is suited for simple recreation and for exercise as well. Though it is an extremely lively device, it has a soft springing action that is easy on the joints while providing a good aerobic workout. As an exercise device, it is intended primarily for adult use. However, it is equally well suited for use as a recreational device or toy by young adults and children. When so used, adult supervision or training is recommended to ensure that the bungee cords are not configured to make the device too lively for the user to control.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. An adjustable jumping apparatus, said apparatus comprising:

a housing having an upper end, a lower end, and at least one vertical side surface, and defining a substantially hollow interior, said lower end having an interior surface;

a first and second foot peg attached to said at least one vertical surface of said housing proximate said lower end of said housing;

a sleeve integrally formed in said lower end of said housing and defining an opening into said housing;

a pole inserted through the opening of said sleeve and extending upwardly into said housing and downwardly to engage the ground when in use, said pole having an upper end and a lower end and matched to the shape of the opening defined by said sleeve;

a base connected to the lower end of said pole;

a disc connected to the upper end of said pole and having an inferior surface;

at least one bungee cord interposed between said interior surface of said lower end of said housing and said inferior surface of said disc;

connection means for connecting said at least one bungee cord to said interior surface of said lower end of said housing and said inferior surface of said disc; and handle bars connected to said upper end of said housing.

2. The adjustable jumping apparatus of claim 1 wherein said housing is substantially cylindrical in shape.

3. The adjustable jumping apparatus of claim 1 wherein said sleeve defines a substantially cylindrical hollow opening into said housing.

4. The adjustable jumping apparatus of claim 3 wherein said pole is substantially cylindrical in shape.

5. The adjustable jumping apparatus of claim 1 wherein said sleeve is integrally connected to the interior surface of the lower end of said housing.

6. The adjustable jumping apparatus of claim 1 wherein said base is fabricated from a rubber material.

7. The adjustable jumping apparatus of claim 1 wherein said connection means comprises hooks at each end of said bungee cord, and a plurality of loops to which said hooks are fastened, said loops fastened to said inferior surface of said disc and said interior surface of said lower end of said housing.

8. The adjustable jumping apparatus of claim 7 wherein said loops are removable.

9. The adjustable jumping apparatus of claim 7 wherein said loops are integral.

10. The adjustable jumping apparatus of claim 1 further wherein said handlebars have a neck and include shock absorbing means located proximate said neck.

11. The adjustable jumping apparatus of claim 10 wherein said shock absorbing means comprises a coil spring.

* * * * *